United States Patent [19]

Drower

[11] Patent Number: 4,936,469

[45] Date of Patent: Jun. 26, 1990

[54] STORAGE RACK FOR SMALL ARTICLES

[75] Inventor: Herbert M. Drower, Wilmette, Ill.

[73] Assignee: Sealtran Corporation, Chicago, Ill.

[21] Appl. No.: 222,011

[22] Filed: Jul. 21, 1988

[51] Int. Cl.[5] ..... A47F 7/00

[52] U.S. Cl. ..... 211/69.8; 211/89; 211/94

[58] Field of Search ..... 211/69.8, 70.6, 89, 211/120, 60.1, 94, 162

[56] References Cited

U.S. PATENT DOCUMENTS

| | | | |
|---|---|---|---|
| D. 175,455 | 8/1955 | Bartleman . | |
| 231,969 | 9/1880 | Perkins | 211/69.8 |
| 586,238 | 7/1897 | King | 211/66 |
| 2,430,624 | 11/1947 | Vollmer | 211/89 X |
| 2,591,805 | 4/1952 | Gossett | 211/89 X |
| 2,615,577 | 10/1952 | Bartleman . | |
| 3,305,100 | 2/1967 | Barbee | 211/120 X |
| 3,405,809 | 10/1968 | Schatz . | |
| 3,812,976 | 5/1974 | Rempel . | |
| 4,176,752 | 12/1979 | Taber | 211/89 X |

*Primary Examiner*—Blair M. Johnson
*Assistant Examiner*—Sarah A. Lechok
*Attorney, Agent, or Firm*—Kinzer, Plyer, Dorn, McEachran & Jambor

[57] ABSTRACT

A storage rack for small articles of all types and configurations incorporates an elongated main support bar with a multiplicity of longitudinally spaced, open top transverse slots; a multiplicity of retainer loops of tough, resilient, abrasion resistant resin such as PET are inserted in and project forwardly from the slots. The ends of the retainer loop legs are bent at right angles and held in a recess in the back of the support bar by a back member, whereas a cover over the tops of the slots precludes upward withdrawal of the retainer loops. A front ledge on the support bar, below the retainer loops, effectively narrows the space between the adjacent retainer loops; a similar ledge is preferably present above the loops.

5 Claims, 4 Drawing Sheets

STORAGE RACK FOR SMALL ARTICLES

BACKGROUND OF THE INVENTION

Storage racks for small articles, ranging from pencils and pens to paint brushes to cassettes and small containers, come in many sizes, styles, constructions and configurations. Many of these storage racks and similar storage devices are expressly designed for and are usable only with articles of a single size and shape. Some utilize resilient clips or other similar resilient metal elements to retain the stored articles in the rack.

Somewhat versatile storage racks for small articles have been known in the prior art. For example, Bartleman U.S. Pat. No. 2,615,577 discloses a rack for hand tools in which the individual tools are suspended from a series of spring clips that can be mounted at varying positions along a multiply slotted main support bar. This storage arrangement is somewhat limited because each tool stored must fit into a given size clip; for a variety of tools different clip sizes must be provided. A slightly more versatile arrangement is disclosed in Schatz U.S. Pat. No. 3,405,809, which carries the Bartleman concept a step further; it utilizes a series of metal spring clips formed from pairs of individual clip arms, again mounted in an elongated slotted rack. The spacing of the arms can be varied to accommodate articles of different sizes.

Yet another more versatile storage rack is described in Rempel U.S. Pat. No. 3,812,976, in which individual storage compartments are formed by a continuous strip of flexible plastic ribbon fitted into an elongated panel in a manner to accommodate a rather wide variety of different shapes of tools or similar articles. The Rempel rack, however, requires that the ribbon portion of the storage rack be set up especially for the articles being stored; any change in these articles requires a new set-up for the ribbon.

SUMMARY OF THE INVENTION

It is a principal object of the present invention, therefore, to provide a new and improved storage rack for small articles that affords maximum versatility and is capable of storing thick, thin, long, and short articles of virtually any shape or configuration with no more than minimum set-up time, frequently zero, required when there is to be a change in the articles stored.

Another object of the invention is to provide a new and improved storage rack for small articles that provides for "soft" retention of the articles in the rack so that they are not likely to be damaged even if the rack is used in a vehicle or other adverse environment.

An additional object of the invention is to provide a new and improved storage rack for small articles that is simple and inexpensive in construction, requires no metal clips or similar parts, yet is capable of service over long duration.

Accordingly, the invention relates to a storage rack for small articles comprising an elongated main support bar having a multiplicity of transverse slots spaced along its length, each slot extending from the front to the back of the support bar and each slot being open at the op of the slot but closed at the bottom of the slot. The storage rack further comprises a multiplicity of retainer loops, each formed of a strip of tough, resilient, abrasion-resistant resin; each retainer loop has two legs with each leg inserted in a slot in the main support bar and the loop projecting out of the front of that bar. An end portion of each leg of each retainer loop is bent approximately normal to the adjacent portion of the loop leg, at the back end of the slot in which the loop leg is inserted, and a backing engages the bent end portions of the retainer loop legs to preclude withdrawal of the loops forwardly through the slots. A cover extends over the slots to preclude withdrawal of the loops in upward direction.

DESCRIPTION OF THE PREFERRED EMBODIMENTS

Figure 1:
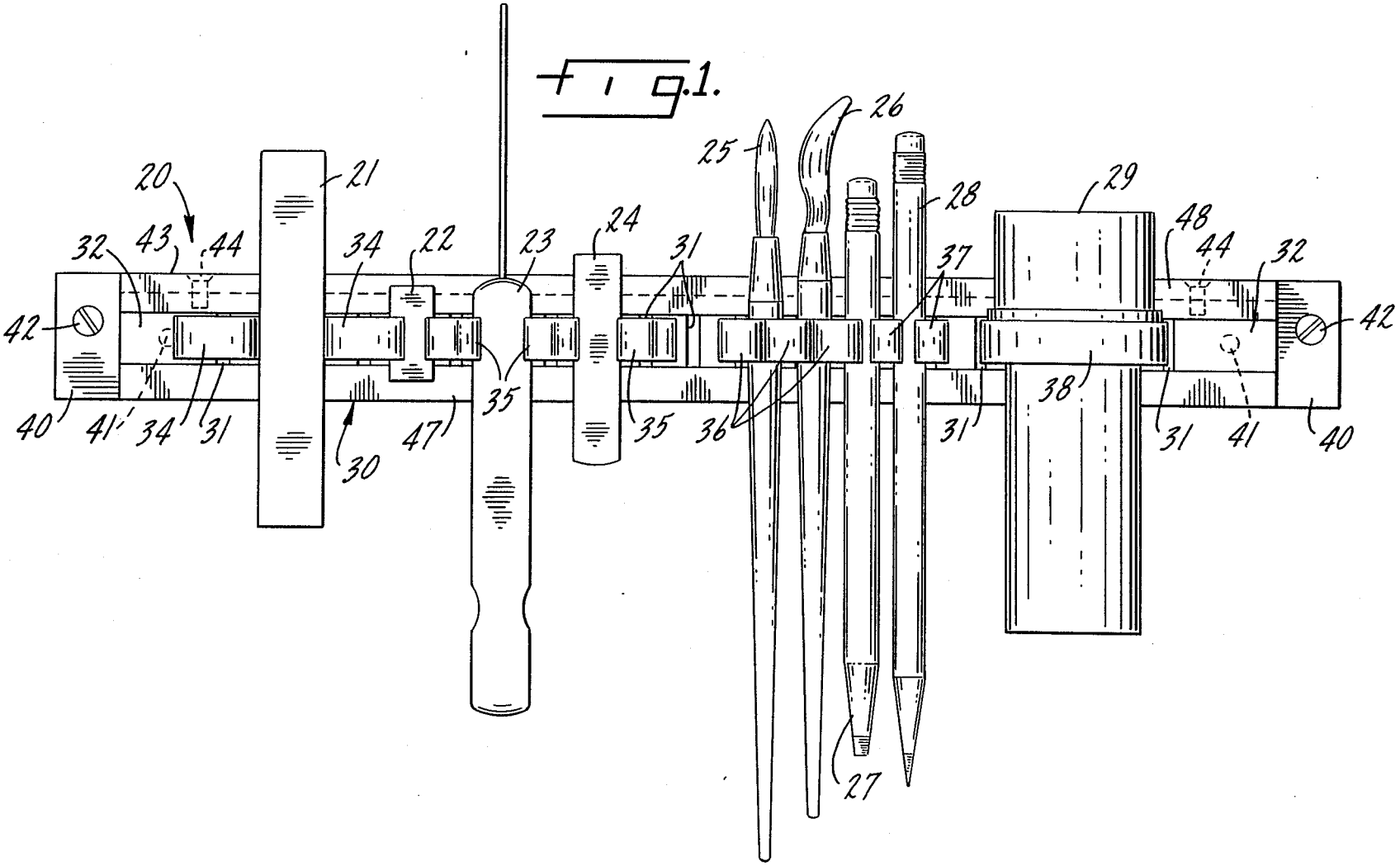
FIG. 1 is an elevation view of a storage rack for small articles constructed in accordance with one embodiment of the present invention.
Figure 2:
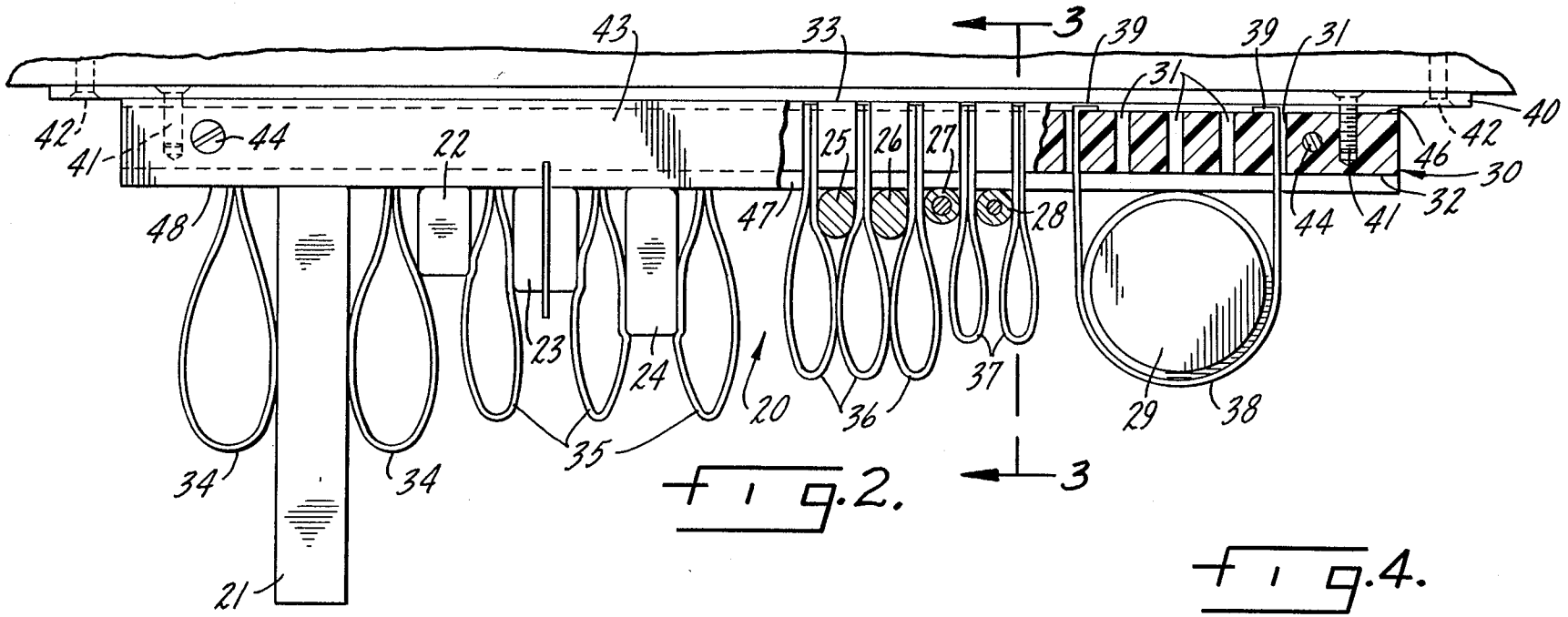
FIG. 2 is a plan view of the storage rack of FIG. 1.

FIGS. 1–4 illustrate a storage rack 20 for storing small articles, constructed in accordance with one preferred embodiment of the present invention. As shown in FIGS. 1 and 2, rack 20 is used for the storage of a variety of different small articles of varying sizes, shapes, and descriptions. Thus, from left to right in these figures, rack 20 is shown as storing a measuring tape 21, a small block of chalk 22, a putty knife 23, an eraser 24, two small paint brushes 25 and 26, two pencils 27 and 28, and a small container 29.

Storage rack 20, FIGS. 1–4, comprises an elongated main support bar 30 having a multiplicity of transverse slots 31 at regularly spaced intervals along its length. In a typical storage rack, the center-to-center spacing between slots 31 may be of the order of three-eighths inch or less, but this spacing is not critical. The more slots 31 there are in main support bar 30, the more versatile the rack; however, when the spacing between slots 31 is reduced to less than one-fourth inch, there is little gain with respect to most of the kinds of small articles for which rack 20 might be used. As will be apparent from the center portion of FIG. 2 and from FIG. 3, each slot 31 is open at its top but closed at its bottom. Each slot 31 extends the full distance from the front 32 of bar 30 to its back surface 33.

Storage rack 20 further comprises a multiplicity of retainer loops. These are shown as four different sizes 34, 35, 36, and 37 of closed retainer loops and one open retainer loop 38. Retainer loops 34–38 are each formed of a strip of tough, resilient, abrasion resistant resin, preferably a polyester resin or laminate. Indeed, the best resin for retainer loops 34–38 is two layers of oriented polyethylene terephthalate laminated with a central layer of polyethylene, the same basic construction as used in commercial identification cards and like articles.

Figure 4:
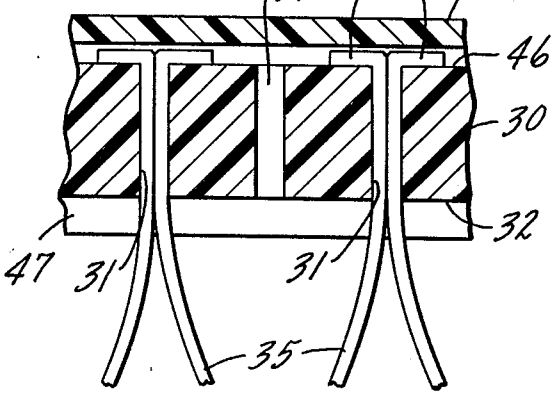
FIG. 4 is an enlarged detail sectional view, from the top, of a portion of the rack of FIGS. 1–3.
Figure 3:
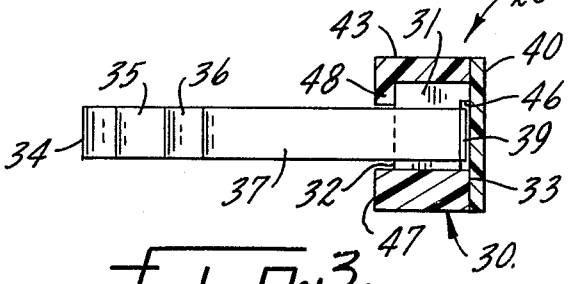
FIG. 3 is a detail sectional view taken approximately as indicated by line 3—3 in FIG. 2.

Each retainer loop has two legs and each leg of each loop is inserted in a slot 31 in the main support bar 30 with the loop itself projecting out of the front of the main support bar, well beyond its front surface 32. As best shown in FIGS. 2 and 4, an end portion 39 of each retainer loop leg is bent approximately normal to the adjacent portion of the loop leg at the back end of the slot 31 into which the loop leg is inserted. A back member 40 secured to the main support bar 30 by suitable screws 41 or other appropriate means engages the bent end portions 39 of the retainer loop legs to preclude withdrawal of the loops forwardly through the slots 31. Back 40 may also be used for mounting rack 20 on a wall or other support, as by means of appropriate screws 42.

Storage rack 20 also includes a cover 43 that extends over all of the slots 31 in support bar 30. Cover 43 is removably mounted upon support bar 30 by appropriate means such as a pair of screws 44 (FIG. 2). Cover 43 precludes withdrawal of loops 34–38 in an upward direction from slots 31. It should be understood that "top" and "bottom", in reference to rack 20, are essentially arbitrary; the rack can be rotated 180° about a longitudinal axis to put cover 43 on the bottom and remains equally usable. It could also be rotated to almost any orientation about a transverse axis and would retain full utility, particularly if the stored articles are not unduly heavy.

A continuous shallow recess 46 extends across the full length of the back surface 33 of main support bar 30. Recess 46 is wide enough to receive the loop leg ends 39 from the retainer loops 34–38. Use of recess 46, in conjunction with back member 40, assures better retention of the retainer loops in storage rack 20.

The bottom of main support bar 30, below slots 31, affords a forwardly projecting ledge 47. Ledge 47 extends throughout the length of support bar 30, immediately below the inner ends of each of retainer loops 34–38. Ledge 47 has little effect with respect to loop 38, which encompasses its stored article 29 (FIGS. 1 and 2). Ledge 47, however, is of greater importance with respect to the closed type of loops exemplified by loops 34–37, with articles stored between adjacent loops, because it provides a rigid structure extending out toward the point of tangential alignment of adjacent retainer loops. Thus, the presence of ledge 47 adds appreciably to the versatility of rack 20 by permitting the storage of small, thin articles that might otherwise slip through between adjacent loops.

At the top of rack 20, cover 43 also projects out over part of each of loops 34–37. The resulting ledge 48 serves the same purpose as ledge 47. Between them, they effectively narrow the space between adjacent closed retainer loops such as loops 34–37 and allow rack 20 to provide effective storage for smaller articles than would otherwise be possible for any given spacing between slots 31.

As can be seen from FIGS. 1 and 2, storage rack 20 can be employed to store a wide variety of different articles with different sizes and shapes. Setting up the storage rack requires minimal time; its cover 43 is removed, in this instance simply by releasing two retainer screws 44. Retainer loops can then be inserted in slots 31 at any desired spacing, depending upon the articles to be stored. The size of the loops may be selected to conform to the articles for which storage is planned. Thus, the largest closed loops 34 may be utilized, on the widest spacing, to accommodate relatively large articles such as tape 21. On the other hand, even the large closed loops can be used for effective storage of relatively small articles as shown by chalk 22 and eraser 24. Appropriate selection of the resilient, tough, abrasion-resistant resin employed for retainer loops 34–38, particularly a resin such as a polyethylene terephthalate/polyethylene laminate that can be bent and set without requiring heating, makes it possible to store an extremely wide variety of small articles, very different from each other, in rack 20. At the same time there is no requirement for any spring metal parts or other expensive components. The entire cost of storage rack 20, despite its great versatility, is very low. On the other hand, wear and tear on rack 20, and particularly retainer loops 34–38, is quite minimal. The storage rack has a long useful life.

Figure 5:
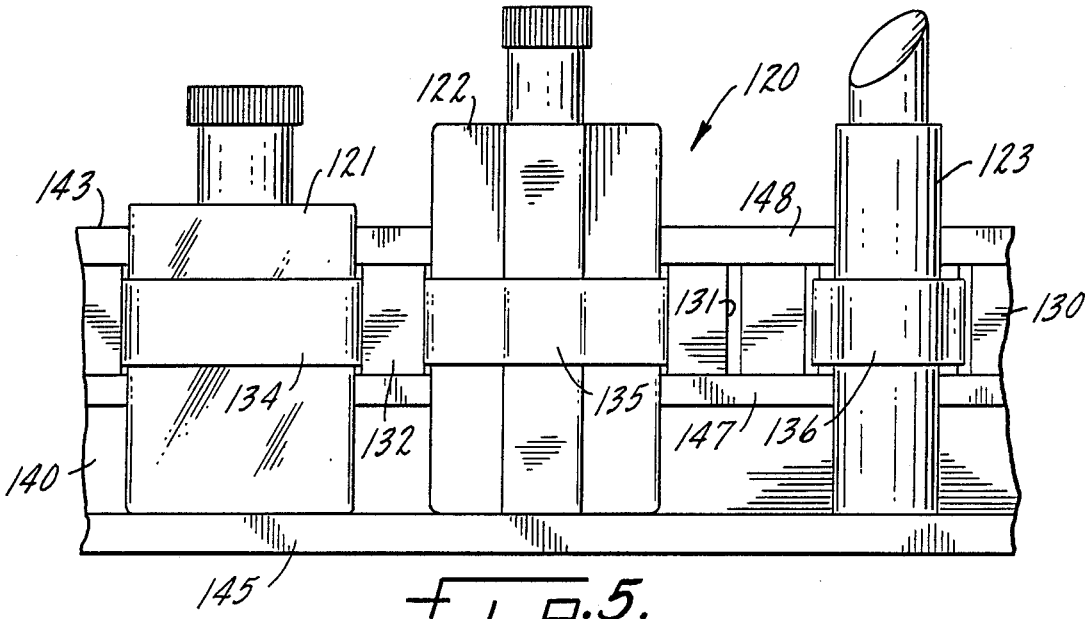
FIG. 5 is a front elevation view of a portion of a storage rack for small articles constructed in accordance with another embodiment of the present invention.
Figure 6:
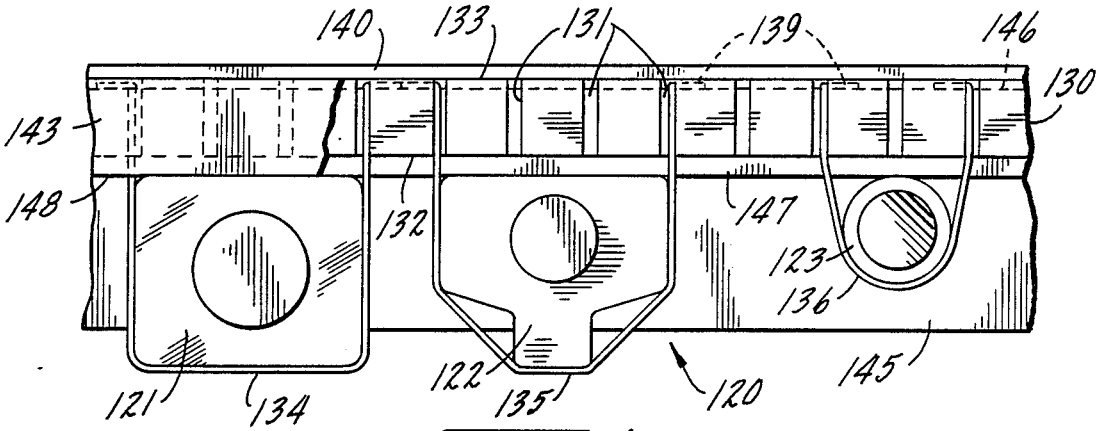
FIG. 6 is a plan view of the portion of a storage rack shown in FIG. 5.

The storage rack 120 illustrated in FIGS. 5 and 6 constitutes another preferred embodiment of the present invention. The portion of rack 120 shown in the drawings is utilized for storage of three articles 121, 123; article 121 is a small container of generally rectangular shape, article 122 is another container of a substantially different configuration, and article 123 is shown as a lipstick or like applicator. The materials from which containers 121–123 are formed are immaterial; they may be glass, metal, plastic, or other appropriate materials.

Rack 120, like the previously described rack 20, comprises an elongated main support bar 130 having a multiplicity of transverse slots 131 spaced throughout its length. Each slot 131 extends from the front surface 132 to the rear surface 133 of support bar 130. Each slot 131 is open at its top and closed at its bottom. Storage rack 120 includes a plurality of retainer loops 134, 135 and 136, each formed from a strip of tough, resilient, abrasion-resistant resin. The preferred resin is a laminate of polyethylene terephthalate and polyethylene. Each retainer loop 134–136 has two legs and each leg is inserted in one of the slots 131 in the main support bar 130, with the loops projecting outwardly from the front surface 132 of bar 130.

A portion 139 at the end of each leg of each loop (FIG. 6) is bent approximately normal to the adjacent portion of the loop leg. These loop leg end portions 139 are all received in a slot 146 in the back surface 133 of main support bar 130 and are held in that slot by a back member 140. As before, back 140 may be utilized to mount rack 120 on a wall or other support. The tops of all of slots 131 are covered by an elongated cover 143 that extends the full length of rack 120. Cover 143 provides a top ledge 148 aligned with a similar forwardly projecting bottom ledge 147, as in the previous construction.

Storage rack 120 has some substantial differences in comparison with the previously described storage rack 20. A principal difference is that back member 140 is extended downwardly and joined to a base or floor 145 on which all of the stored articles 121–123 may be supported. Thus, in rack 120 retainer loops 134–136 do not need to sustain the weight of stored articles 121–123. Rack 120 can still be changed in its orientation, but is best used in the illustrated orientation to get the full benefit of base 145.

In rack 120 each of the retainer loops 134–136 is formed with a configuration that is matched to the shape of the article stored. That is, each retainer loop shown in rack 120 is shaped to fit the article that it stores in the rack; the conformity is very close for container 121 and retainer loop 134 but there are greater differences for the other articles stored in rack 120. Of course, rack 120 can also use closed loop retainers such as retainer loops 34–37 in the previously described embodiment.

Shaping retainer loops 134–136 is not a substantial problem, particularly when the preferred resin PET is used. Thus, the selected resin or laminate should be one that can be shaped with pliers or other hand tools and will hold its shape. Alternatively, for mass production of storage racks used in retail establishments and other similar applications, appropriate tooling for shaping the retainer strips in a press is generally quite inexpensive. Thus, a loop shape that is complementary to virtually any specific article to be stored in rack 120 (or in rack 20, for that matter) can be readily and rapidly fabricated.

Figure 7:
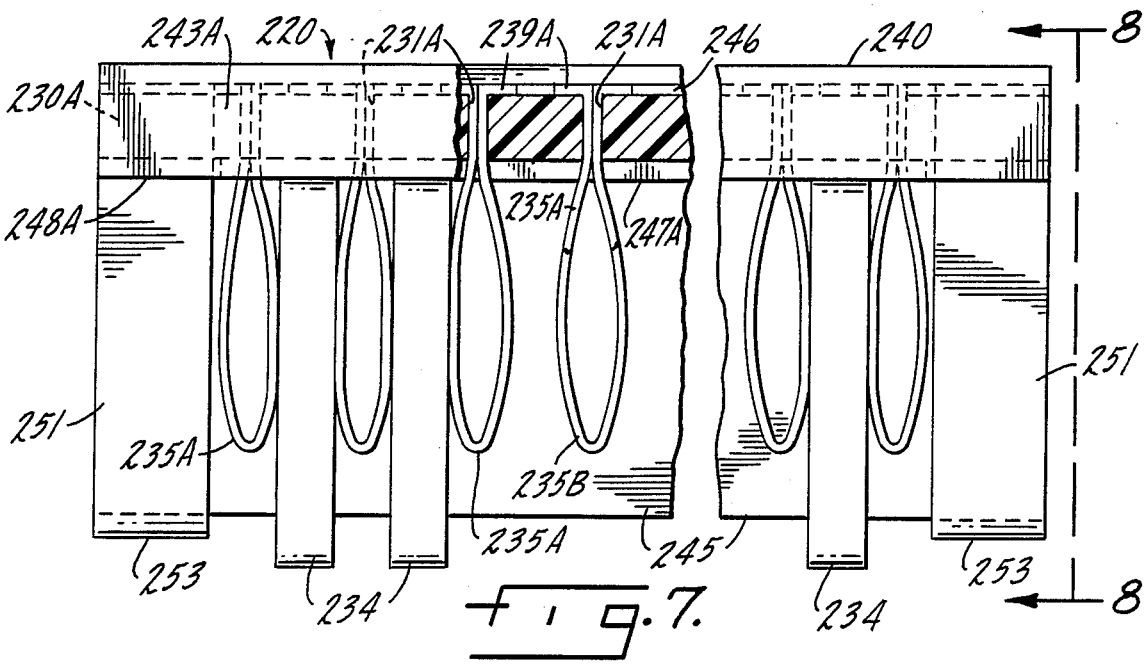
FIG. 7 a plan view of a storage rack for cassettes constructed in accordance with a further embodiment of the present invention.
Figure 8:
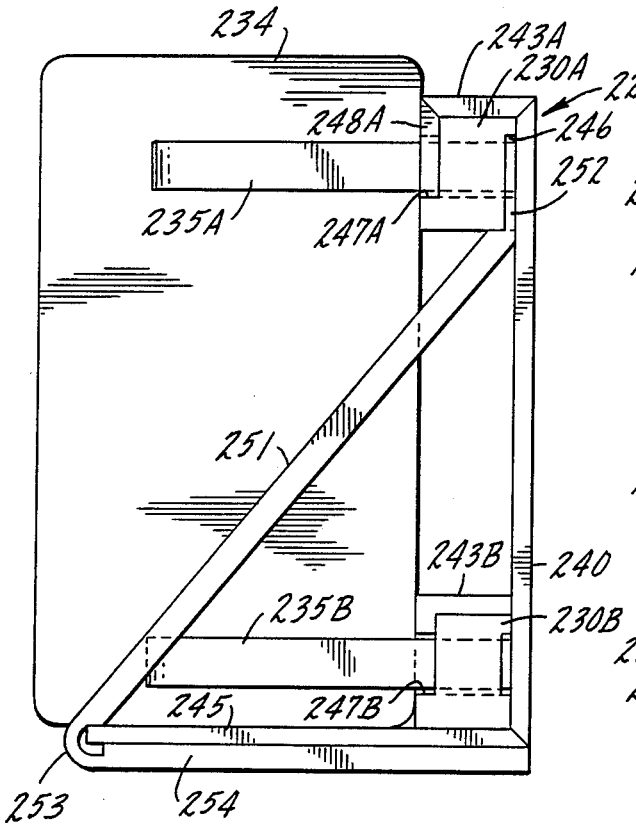
FIG. 8 is an end elevation view taken approximately as indicated by line 8—8 in FIG. 7.
Figure 9:
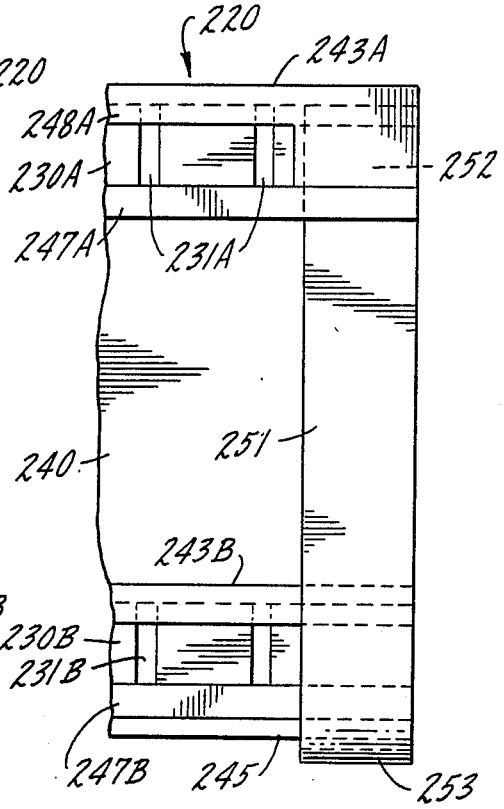
FIG. 9 is a front elevation view of a portion of the rack of FIGS. 7 and 8 with the retainer loops removed to show additional structure.

FIGS. 7–9 illustrate a storage rack 220 for small articles that comprises yet another preferred embodiment of the present invention. Rack 220 is utilized for storage of a plurality of magnetic tape cassettes 234; cassettes 234 may be for audio or visual data, depending upon their size. A more enclosed version of rack 220 may be used in automobiles or other vehicles for storage of cassettes, particularly audio cassettes and is particularly advantageous in that environment because the retainer loops of the storage rack have enough "give" to them to provide for "soft" storage.

Storage rack 220, FIGS. 7–9, includes two elongated main storage support bars 230A and 230B. Bar 230A is provided with a multiplicity of transverse open-top slots 231A, as in the previously described embodiments. Similarly, support bar 230B includes a multiplicity of transverse slots 231B that are aligned with slots 231A as seen in FIG. 9. Slots 231A and 231B each extend from the front to the rear of the support bar in which they are formed.

Storage rack 220 utilizes a multiplicity of retainer loops for the storage of cassettes 234. Because the cassettes all have the same size and shape, all of the retainer loops in rack 220 are of the same construction. Thus, the retainer loops 235A have their legs inserted in the slots 231A in the top support bar 230 with their leg ends 239A bent at right angles and fitted into a recess 246 (FIGS. 7 and 8) that extends across the back of support bar 230A. A similar construction is utilized for retainer loops 235B in mounting those retainer loops in the lower main support bar 230B. The back recesses in each of support bars 230A and 230B are covered by a single unitary back member 240 that is a part of a support frame for rack 220 as described hereinafter.

As before, retainer loops 235A and 235B are each formed from a strip of a tough, resilient, abrasion-resistant resin, preferably a polyester. More specifically, an oriented polyethylene terephthalate laminated with polyethylene is preferred. Typically, the thickness for retainer loops 235A and 235B may be in the range of 0.003 inch to 0.06 inch, though the appearance of the thinner loops may not be desirable. Retainer loops of this type afford a "soft" storage with considerable give so that cassettes 234 are not damaged even in an adverse environment.

Rack 220, FIGS. 7–9, includes a frame formed of a relatively thick, rigid sheet resin material. The main part of the frame is formed by a continuous rigid sheet notched and folded in the same manner as frequently employed for three-ring binders. The frame includes a floor or support base 245, back 240, and a top 243A that serves as the cover for support bar 230A. A separate cover 243B is supplied for the other support bar 230B. Cover 243A is cut away to afford a front ledge 248A over retainer loops 235A. Bar 230A preferably has a lower front ledge 247A and bar 230B has a similar lower ledge 247B.

The frame of storage rack 220 further comprises two braces 251 at opposite ends of the rack as shown in FIG. 7. Braces 251 extend at an angle from near the top of back 240 to the forward edge of base 245. At its top, each brace 251 is shaped to afford a relatively thin upward extension 252 set into a recess in support bar 230 as shown in FIGS. 8 and 9. At its lower end, each angle brace 251 has a section 253 of reduced thickness that curls around the end of base 245 and extends backwardly under the base to afford a support pedestal 254 (FIG. 8).

From the foregoing description, it can be seen that each embodiment of the storage rack of the present invention is highly versatile and can be used for storage of a wide variety of different small articles of varying sizes, shapes, weights, and configurations. This applies even to the rack 220 of FIGS. 7–9; though shown as a storage device for cassettes 234 of uniform shape, rack 220 can be readily converted to a variety of different articles, in the same manner as the other racks, simply by substitution of other retainer loops for those shown, with variation in loop spacing as necessary. The storage racks of the invention afford a long life yet are quite simple and inexpensive in construction.

I claim:

1. A storage rack for small articles comprising:

a rigid frame, formed of resin;

an elongated main support bar, mounted on and supported by the frame, having a multiplicity of transverse slots spaced along its length, each slot extending from the front to the back of the support bar and each slot being open at the top of the slot but closed at the bottom of the slot;

a multiplicity of individual retainer loops, each a separate member formed of a strip of tough, resilient, abrasion resistant resin, each retainer loop having two legs each inserted in one of the transverse slots in the main support bar with the loop projecting out from the front of the main support bar;

an end portion of each leg of each retainer loop being bent approximately normal to the adjacent portion of the loop leg, at the back end of the slot in which a the loop leg is inserted;

back cover means engaging the bent end portions of the retainer loop legs to preclude withdrawal of the loops forwardly through the slots;

and top cover means, extending over the slots, to preclude withdrawal of the upwardly from the slots.

2. A storage rack for small articles, according to claim 1, in which the backing means and the cover means are both an integral part of the frame.

3. A storage rack for small articles comprising:

a substantially rigid frame, formed of thick, rigid sheet resin;

first and second elongated main support bars, mounted in spaced relation to each other on the frame, each support bar having a multiplicity of transverse slots spaced along its length, each slot extending from the front to the back of its support bar and each slot being open at the top of the slot but closed at the bottom of the slot;

a multiplicity of retainer loops each formed of a strip of tough, resilient, abrasion resistant resin, each retainer loop having two legs inserted in the slots in one of the main support bars with the loop projecting out of the front of that main support bar;

an end portion of each leg of each retainer loop being bent approximately normal to the adjacent portion of that loop, at the back end of the slot in which the loop leg is inserted;

first and second backing means, each engaging the bent end portions of the retainer loop legs on one support bar to preclude withdrawal of the loops forwardly through the slots, from back to front;

and first and second cover means, each extending over the slots in one support bar, to preclude withdrawal of the loops upwardly from the slots.

4. A storage rack for small articles, according to claim 3 in which the frame also affords a base surface for supporting the articles.

5. A storage rack for small articles comprising:

an elongated main support bar having a multiplicity of transverse slots of predetermined width spaced along its length, each slot extending from the front to the back of the support bar and each slot being open at the top of the slot but closed at the bottom of the slot;

a bottom ledge member mounted on and projecting outwardly beneath the front edges of all of the slots;

a multiplicity of retainer loops each formed of a strip of given thickness less than half the slot width, formed of a tough, resilient, abrasion resistant resin comprising a laminate of polyethylene and polyethylene terephthalate, each retainer loop having two legs each inserted in a slot in the main support bar with the loop projecting out of the front of the main support bar;

a plurality of the retainer loops being closed loops that have both legs inserted in one slot in the main support bar, and a part of each loop being supported on the bottom ledge of the main support bar;

an end portion of each leg of each retainer loop being bent approximately normal to the adjacent portion of the loop leg, at the back end of the slot in which the loop leg is inserted;

the main support bar having a continuous, elongated back recess extending across the back ends of all of the slots, for receiving the bent back end portions of all of the retainer loops;

back cover means engaging the bent end portions of the retainer loop legs to preclude withdrawal of the loops forwardly through the slots and covering the back recess in the main support bar throughout the length of the recess;

and top cover means, removably mounted on the main support bar and extending over the slots to preclude withdrawal of the loops upwardly from the slots, the top cover means including a ledge projecting outwardly over the front of the main support bar, immediately above the retainer loops.

* * * * *